US008314667B2

(12) United States Patent
Uhm et al.

(10) Patent No.: US 8,314,667 B2
(45) Date of Patent: Nov. 20, 2012

(54) COUPLED LINE FILTER AND ARRAYING METHOD THEREOF

(75) Inventors: Man-Seok Uhm, Daejon (KR); Youn-Sub Noh, Daejon (KR); Changsoo Kwak, Daejon (KR); So-Hyeun Yun, Daejon (KR); Kiburm Ahn, Daejon (KR); In-Bok Yom, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 368 days.

(21) Appl. No.: 12/607,884

(22) Filed: Oct. 28, 2009

(65) Prior Publication Data

US 2010/0141356 A1 Jun. 10, 2010

(30) Foreign Application Priority Data

Dec. 9, 2008 (KR) ..... 10-2008-0124650
Mar. 17, 2009 (KR) ..... 10-2009-0022531

(51) Int. Cl.
*H01P 1/203* (2006.01)

(52) U.S. Cl. ..... 333/204
(58) Field of Classification Search ..... 333/203–205, 333/219
See application file for complete search history.

(56) References Cited

U.S. PATENT DOCUMENTS

| | | | | |
|---|---|---|---|---|
| 4,721,931 | A * | 1/1988 | Nishikawa et al. | 333/203 |
| 5,621,366 | A * | 4/1997 | Gu et al. | 333/204 |
| 6,801,101 | B2 * | 10/2004 | Hiroshima et al. | 333/134 |
| 6,903,632 | B2 * | 6/2005 | Hashimoto et al. | 333/204 |
| 7,561,012 | B2 * | 7/2009 | Fukunaga | 333/204 |
| 2001/0040490 | A1 * | 11/2001 | Tanaka | 333/204 |
| 2004/0041663 | A1 | 3/2004 | Uchimura et al. | |
| 2006/0082425 | A1 | 4/2006 | Jun et al. | |
| 2007/0120628 | A1 | 5/2007 | Jun et al. | |
| 2008/0252400 | A1 | 10/2008 | Kayano et al. | |

FOREIGN PATENT DOCUMENTS

| | | | |
|---|---|---|---|
| JP | 2007-096934 | A | 4/2007 |
| KR | 10-1999-0065847 | A | 8/1999 |
| KR | 10-2004-0050100 | A | 6/2004 |
| KR | 10-2006-0034177 | A | 4/2006 |

OTHER PUBLICATIONS

Isabel Ferrer et al., "A 60 GHz Image Rejection Filter Manufactured Using a High Resolution LTCC Screen Printing Process", 33rd European Microwave Conference, 2003, pp. 423-425, vol. 1, Munich.
Jong-Hoon Lee et al., "A V-Band Front-End With 3-D Integrated Cavity Filters/Duplexers and Antenna in LTCC Technologies", IEEE Transactions on Microwave Theory and Techniques, Jul. 2006, pp. 2925-2936, vol. 54, No. 7.

* cited by examiner

*Primary Examiner* — Seungsook Ham

(57) ABSTRACT

A coupled line filter includes: a first line resonator connected input port and a second line resonator connected with output port each having an electrical length of 270° at a predetermined center frequency, the first and second line resonators being disposed parallel to each other; and a third line resonator including one or more line resonators disposed between the first line resonator and the second line resonator, each line resonator having an electrical length of 90° at the center frequency and a first side aligned with first sides of the first line resonator and the second line resonator, wherein an order of the coupled line filter is determined by summing the number of the line resonators included in the third line resonator and the first and second line resonators.

20 Claims, 7 Drawing Sheets

COUPLED LINE FILTER AND ARRAYING METHOD THEREOF

CROSS-REFERENCES TO RELATED APPLICATIONS

The present invention claims priority of Korean Patent Application Nos. 10-2008-0124650 and 10-2009-0022531, filed on Dec. 9, 2008, and Mar. 17, 2009, respectively, which are incorporated herein by reference.

BACKGROUND OF THE INVENTION

1. Field of the Invention

The present invention relates to a coupled line filter; and, more particularly, to a coupled line filter usable in high frequency band.

2. Description of Related Art

Very high frequency is drawing attention as a radio frequency band favorable for using broadband signals and processing data at high speed. Specifically, frequency bands over 60 GHz are preferred and studied in both domestic and overseas countries to develop components and systems therefore. Also, to minimize the size of components and reduce the costs, Low-Temperature Co-fired Ceramic (LTCC) technology for three-dimensional integration is applied thereto.

Meanwhile, one of the essential components for a wireless communication system is a filter for selecting signals within desired frequency band. The filter has been an obstacle to miniaturization and cost reduction of the wireless communication system. In the wireless communication system, a filter using a lumped element, a microstrip or strip line filter using a transmission line, a resonator filter, a waveguide filter, and a surface acoustic wave (SAW) filter are used.

Among the diverse filters, the resonator filter is mainly used for microwave band due to its good electrical performances. The resonator filter is formed of resonators and coupling elements between them, and it can have very low losses in the desired frequency band. Also, the structure of resonators should be able to provide a coupling amount between resonators with very wide utility range to acquire the target frequency bandwidth. However, the resonator filter with a phase of approximately 90° transmission lines is rarely used to get low insertion losses in mm wave region because the resonator filter has a low quality coefficient when the coefficient filter uses a transmission line between the top and bottom surfaces that are grounded.

To make the filter using a transmission line have high quality coefficient, the insertion loss characteristics of the transmission line should be excellent. For this reason, a filter using a waveguide surrounded by a conductive material is usually used instead of the transmission line type filter. In the LTCC technology, the filter having a waveguide is realized by surrounding a side surface with multiple vias instead of the conductive material.

The LTCC filter using a waveguide has a resonator form and a structure coupling resonators similar to a conventional waveguide filter. If there is any difference, a first one of the resonators is directly coupled with an input port through microstrip line and waveguides stacked in multiple layers are connected through slots in the LTCC filter. U.S. Patent Publication Nos. 2004-0041663 and 2007-0120628 disclose such LTCC filters using a waveguide. However, the disclosed technologies has small number of coupling between resonators and the coupling amount between input/output port and a resonator is very small, there is a limitation in realizing a filter having broadband characteristics.

Meanwhile, among coupled line filters used in microwave band is an inter-digital filter, which will be described in detail with reference to the accompanying drawing.

FIG. 1 illustrates a typical inter-digital filter.

Referring to FIG. 1, a general inter-digital filter is a kind of a band pass filter used in microwave band. The band pass filter has a form of a planar substrate and a plurality of line resonators 110, 120, 130, 140, and 150 are disposed between an input line and an output line. The line resonators 110, 120, 130, 140, and 150 are realized by a plurality of transmission lines of the same form. The line resonators 110, 120, 130, 140, and 150 are disposed with a predetermined space between them. In FIG. 1, the space between the line first resonator 110 and the second line resonator 120 is marked as g12 and the space between resonators is determined according to a designed bandwidth. The line resonators 110, 120, 130, 140, and 150 are grounded only on one side and the grounded side is alternate. For example, when first sides (which is the lower sides) of the odd line resonators 110, 130, and 150 are grounded, the second sides (which is the upper sides) of the even line resonators 120 and 140 are grounded.

The line resonators 110, 120, 130, 140, and 150 of the inter-digital filter should have an electrical length of 90° at the center frequency of a band desired by a user. Here, the line resonators 110, 120, 130, 140, and 150 having an electrical length of 90° at the center frequency signifies that each of the line resonators 110, 120, 130, 140, and 150 has a length of $\lambda/4$ at the center frequency, where $\lambda$ denotes a wavelength. For example, at 1 GHz, $1\lambda$ is 300 mm. Thus, a length of a line resonator at 1 GHz should be 75 mm to have an electrical length of 90°. Since the higher the frequency is, the shorter the wavelength becomes, the length of the line resonator becomes short.

To sum up, since a wavelength at a high frequency is short, the line resonator has to become short. For instance, when the center frequency is 60 GHz, a length of a line resonator should be 1.25 mm (in the air) to have an electrical length of 90° in the free space. However, when the inter-digital filter of FIG. 1 is actually designed, that is when the line resonators are realized on a predetermined substrate, the length of the line resonators is not that long compared to its width. Also, when the resonators become short, the quality coefficient (Q) affecting the insertion loss of the inter-digital filter becomes low.

This problem can be solved by using line resonators having an electrical length of 270° at high frequency instead of using those having an electrical length of 90°. However, when a coupled line filter is formed using the line resonators having an electrical length of 270°, there is a problem of a pass band being formed in a low frequency band, which is not desired by a user.

SUMMARY OF THE INVENTION

An embodiment of the present invention is directed to providing a coupled line filter having broadband characteristics and low insertion loss.

Another embodiment of the present invention is directed to providing a coupled line filter which can form a pass band only in the frequency band desired by a user.

Another embodiment of the present invention is directed to providing a coupled line filter appropriate for a substrate having a multi-layer structure.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided a coupled line filter, including: a first line resonator and a second line resonator each having an electrical length of 270° at a predetermined center frequency and connected to an input port and an output port, the first and second line resonators being disposed parallel to each other; and a third line resonator including one or more line resonators disposed between the first line resonator and the second line resonator, each line resonator having an electrical length of 90° at the center frequency and a first side aligned with first sides of the first line resonator and the second line resonator, wherein an order of the coupled line filter is determined by summing the number of the line resonators included in the third line resonator and the first and second line resonators.

In accordance with another aspect of the present invention, there is provided a method for arraying line resonators in a coupled line filter, including: disposing a first line resonator and a second line resonator both having an electrical length of 270° at a predetermined center frequency in parallel to each other; disposing a third line resonator including one or more line resonators having an electrical length of 90° at the center frequency between the first line resonator and the second line resonator, wherein first sides of the line resonators of the third line resonator are disposed on first sides of the first line resonator and the second line resonator.

DESCRIPTION OF SPECIFIC EMBODIMENTS,

The advantages, features and aspects of the invention will become apparent from the following description of the embodiments with reference to the accompanying drawings, which is set forth hereinafter. The terms used hereafter are to help understand the present invention and different terms may be different according to a manufacturer and a research group although they are used for the same purposes.

Figure 2:
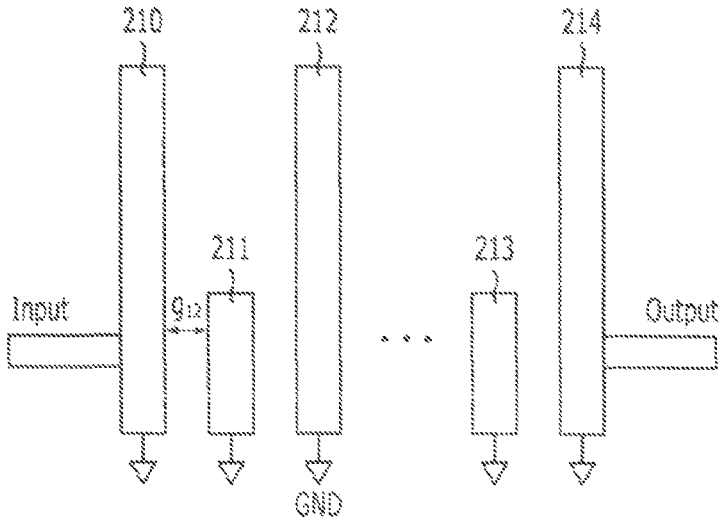
FIG. 2 describes a coupled line filter in accordance with a first embodiment of the present invention.

FIG. 2 describes a coupled line filter in accordance with a first embodiment of the present invention.

Referring to FIG. 2, the coupled line filter of the first embodiment of the present invention includes an input line, an output line, and a plurality of line resonators 210, 211, 212, . . . , 213, and 214.

The input line is directly connected to the first line resonator 210, and the output line is directly connected to the last line resonator 214. The number of the line resonators 210, 211, 212, . . . , 213, and 214 is determined based on the order desired by a user. When a user wants to design a 3-order coupled line filter, the coupled line filter is realized with three line resonators.

Also, each of the line resonators 210, 211, 212, . . . , 213, and 214 has a width determined based on the design value and the line resonators 210, 211, 212, . . . , 213, and 214 are disposed in parallel. However, as illustrated in FIG. 2, the lengths of the line resonators 210, 211, 212, . . . , 213, and 214 are different from each other. In other words, among the line resonators 210, 211, 212, . . . , 213, and 214, the line resonators shown in FIG. 2, the line resonators 210, 212, . . . , 214 disposed at the odd number places from the input line, which will be referred to as odd number-placed line resonators, hereafter, has a first length which is predetermined, whereas the line resonators 211, . . . , 213 disposed at the even number places from the input line, which will be referred to as even number-placed line resonators, hereafter, has a second length which is also predetermined.

In the first embodiment of the present invention, it is assumed that the first length and the second length are different and the first length is longer than the second length. The second length of the even number-placed line resonators 211, . . . , 213 may be a third of the first length of the odd number-placed line resonators 210, 212, . . . , 214. The electrical length of the odd number-placed line resonators 210, 212, . . . , 214 may be 270° while the electrical length of the even number-placed line resonators 211, . . . , 213 may be 90°.

Also, each of the line resonators 210, 211, 212, . . . , 213, and 214 has one side grounded. Here, the grounding may be realized in the form of a ground line (now shown) and it may be directly connected to each of the line resonators 210, 211, 212, . . . , 213, and 214. Also, a ground surface (not shown) may be disposed over or under a predetermined substrate where the line resonators 210, 211, 212, . . . , 213, and 214 are arrayed and connected to the line resonators 210, 211, 212, . . . , 213, and 214 for grounding through multiple vias. The ground surface (not shown) may be described in detail later with reference to FIG. 10.

The line resonators 210, 211, 212, . . . , 213, and 214 have both sides but only one side of them is grounded. Moreover, the line resonators 210, 211, 212, . . . , 213, and 214 are grounded only in one direction.

Also, the grounded sides of the odd number-placed line resonators 210, 212, . . . , 214 may be arrayed in a similar position to the grounded sides of the even number-placed line resonators 211, . . . , 213.

Figure 3:
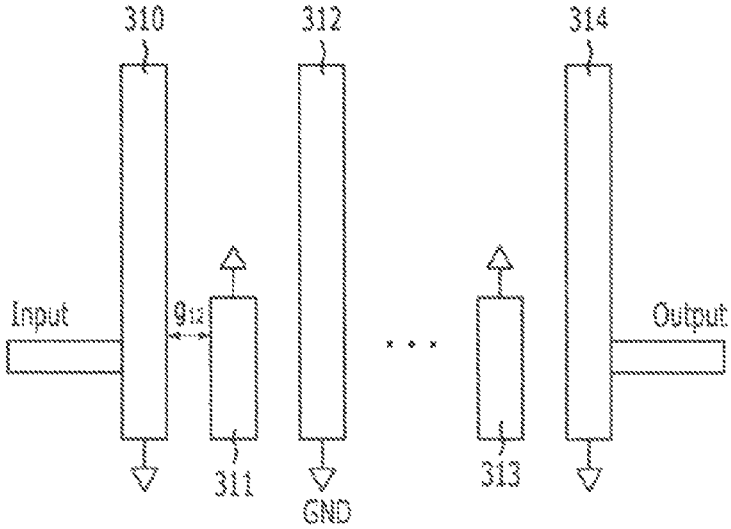
FIG. 3 describes a coupled line filter in accordance with a second embodiment of the present invention.

FIG. 3 describes a coupled line filter in accordance with a second embodiment of the present invention.

Referring to FIG. 3, the coupled line filter of the second embodiment of the present invention has a similar structure to the coupled line filter of the first embodiment illustrated in FIG. 2. The difference between the two coupled line filters is that the coupled line filter of the second embodiment has a grounding direction of the line resonators 310, 311, 312, . . . , 313, and 314 which is different from the grounding direction of the line resonators 210, 211, 212, . . . , 213, and 214. In other words, among the multiple line resonators 310, 311, 312, . . . , 313, and 314, the even number-placed line resonators 311, . . . , 313 have the other side grounded. Here, the other side of the even number-placed line resonators 311, . . . , 313 means the side where the odd number-placed line resonators 310, 312, . . . , 314 are not disposed.

The embodiments of the present invention illustrated in FIGS. 2 and 3 show short resonators having the same grounding direction as long resonators or having their grounding direction in opposite to the long resonators. The coupled line filters illustrated in FIGS. 2 and 3 have similar effects but the coupled line filter of the first embodiment illustrated in FIG. 2 has a smaller coupling amount than the coupled line filter of the second embodiment shown in FIG. 3, because its line resonators have the same grounding direction. Therefore, the coupled line filter of the second embodiment illustrated in FIG. 3 is more effective between the two coupled line filters.

Figure 4:
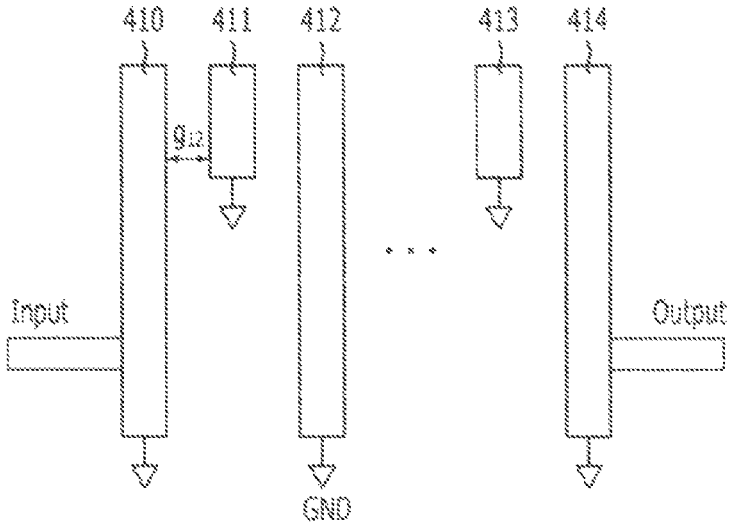
FIG. 4 describes a coupled line filter in accordance with a third embodiment of the present invention.

FIG. 4 describes a coupled line filter in accordance with a third embodiment of the present invention.

Referring to FIG. 4, the coupled line filter of the third embodiment of the present invention is similar to the coupled line filter of the first embodiment shown in FIG. 2. The difference between the two coupled line filters is that the even number-placed line resonators 211, . . . , 213 of the coupled line filter of the first embodiment shown in FIG. 2 are disposed on one side of the odd number-placed line resonators 210, 212, . . . , 214, while the even number-placed line resonators 411, . . . , 413 of the coupled line filter of the third embodiment shown in FIG. 4 are disposed on the other side of the odd number-placed line resonators 410, 412, . . . , 414. The even number-placed line resonators 411, . . . , 413 of the coupled line filter of the third embodiment shown in FIG. 4 are grounded in a direction toward the side of the odd number-placed line resonators 410, 412, . . . , 414 where the even number-placed line resonators 411, . . . , 413 are not disposed.

Figure 5:
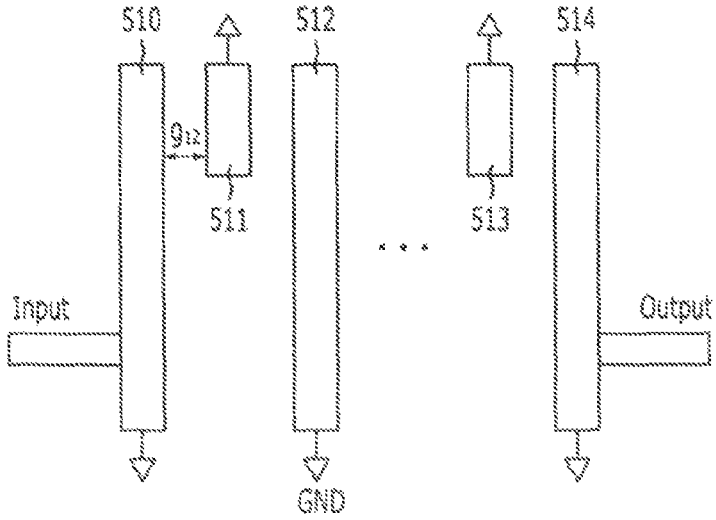
FIG. 5 describes a coupled line filter in accordance with a fourth embodiment of the present invention.

FIG. 5 describes a coupled line filter in accordance with a fourth embodiment of the present invention.

Referring to FIG. 5, the coupled line filter of the fourth embodiment of the present invention is similar to the coupled line filter of the second embodiment of the present invention shown in FIG. 3. The difference between the two coupled line filters is that the even number-placed line resonators 311, . . . , 313 of the coupled line filter of the second embodiment shown in FIG. 3 are disposed on one side of the odd number-placed line resonators 310, 312, . . . , 314, while the even number-placed line resonators 511, . . . , 513 of the coupled line filter of the fourth embodiment shown in FIG. 5 are disposed on the other side of the odd number-placed line resonators 510, 512, . . . , 514. The even number-placed line resonators 511, . . . , 5513 of the coupled line filter of the fourth embodiment shown in FIG. 5 are grounded in a direction toward the side of the odd number-placed line resonators 410, 412, . . . , 414 where the even number-placed line resonators 411, . . . , 413 are disposed.

The embodiments of the present invention illustrated in FIGS. 4 and 5 show short resonators having the same grounding direction as long resonators or having their grounding direction in opposite to the long resonators. The coupled line filters illustrated in FIGS. 4 and 5 have similar effects but the coupled line filter of the third embodiment illustrated in FIG. 4 has a smaller coupling amount than the coupled line filter of the fourth embodiment shown in FIG. 5, because its line resonators have the same grounding direction. Therefore, the coupled line filter of the fourth embodiment illustrated in FIG. 5 is more effective between the two coupled line filters.

Figure 6:
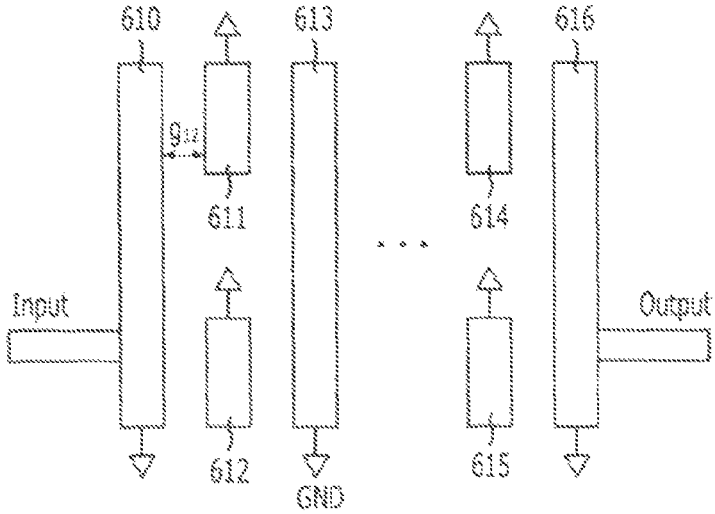
FIG. 6 describes a coupled line filter in accordance with a fifth embodiment of the present invention.

FIG. 6 describes a coupled line filter in accordance with a fifth embodiment of the present invention.

Referring to FIG. 6, the coupled line filter of the fifth embodiment of the present invention has a structure where the even number-placed line resonators 511, . . . , 513 of the coupled line filter of the fourth embodiment shown in FIG. 5 are added to the structure of the coupled line filter of the second embodiment shown in FIG. 3.

In the coupled line filter of the fifth embodiment, even number-placed line resonators 611, 612, . . . , 614, 615 have an electrical length of 90°, and since they are disposed on both sides of the first line resonator 610 and the last line resonator 616, the gap between the second line resonators 611 and 612 becomes $\lambda/4$.

Figure 7:
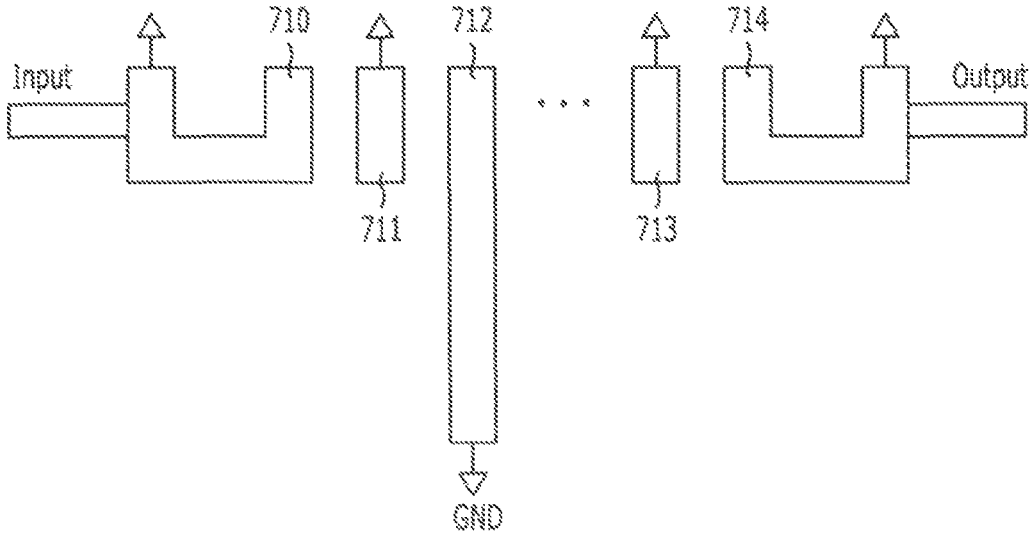
FIG. 7 describes a coupled line filter in accordance with a sixth embodiment of the present invention.

FIG. 7 describes a coupled line filter in accordance with a sixth embodiment of the present invention.

Referring to FIG. 7, the coupled line filter of the sixth embodiment of the present invention has the structure of the coupled line filter of the fourth embodiment illustrated in FIG. 5 except for the first line resonator 510 and the last line resonator 514 among the line resonators 510, 511, 512, . . . , 513, and 514. The other line resonators 511, 512, . . . , 513 are the same.

The first line resonator 710 and the last line resonator 714 have a U shape. Although the first line resonator 710 and the last line resonator 714 are bent in a U shape, they maintain the electrical length of 270°.

Figure 8:
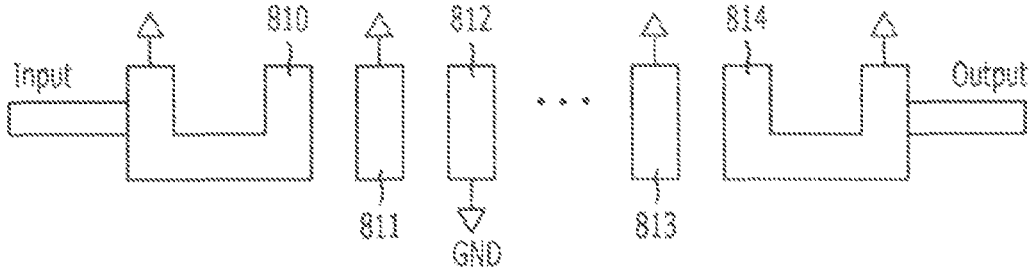
FIG. 8 describes a coupled line filter in accordance with a seventh embodiment of the present invention.

FIG. 8 describes a coupled line filter in accordance with a seventh embodiment of the present invention.

Referring to FIG. 8, the coupled line filter of the seventh embodiment of the present invention is similar to the coupled line filter of the sixth embodiment of the present invention. The difference between the two coupled line filters is that all the line resonators 811, 812, . . . , 813 have an electrical length of 90° except for the first line resonator 810 and the last line resonator 814.

As described above, since the coupled line filters according to the embodiments of the present invention illustrated in FIGS. 2 to 8 have their resonators formed by using less transmission lines than transmission lines used in a general inter-digital filter, they are economical. Moreover, since they use a multi-layered substrate, they are advantageous in that they can be easily integrated with other circuits.

Also, the coupled line filters according to the embodiments of the present invention illustrated in FIGS. 2 to 8 have another advantage of not making a pass band in a low frequency band other than the high frequency band desired by a user. Furthermore, they have broadband characteristics and low insertion rate as well. These advantageous aspects will be described with reference to the accompanying drawings, hereafter.

Figure 1:
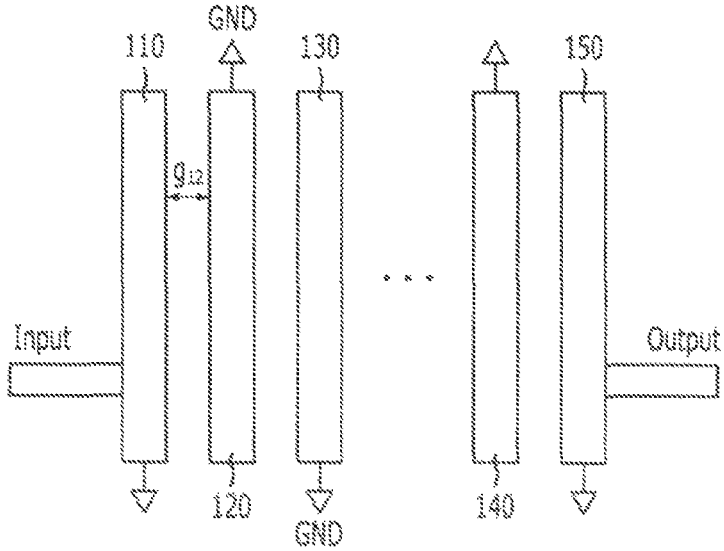
FIG. 1 (PRIOR ART)
FIG. 1 illustrates a typical inter-digital filter.
Figure 9:
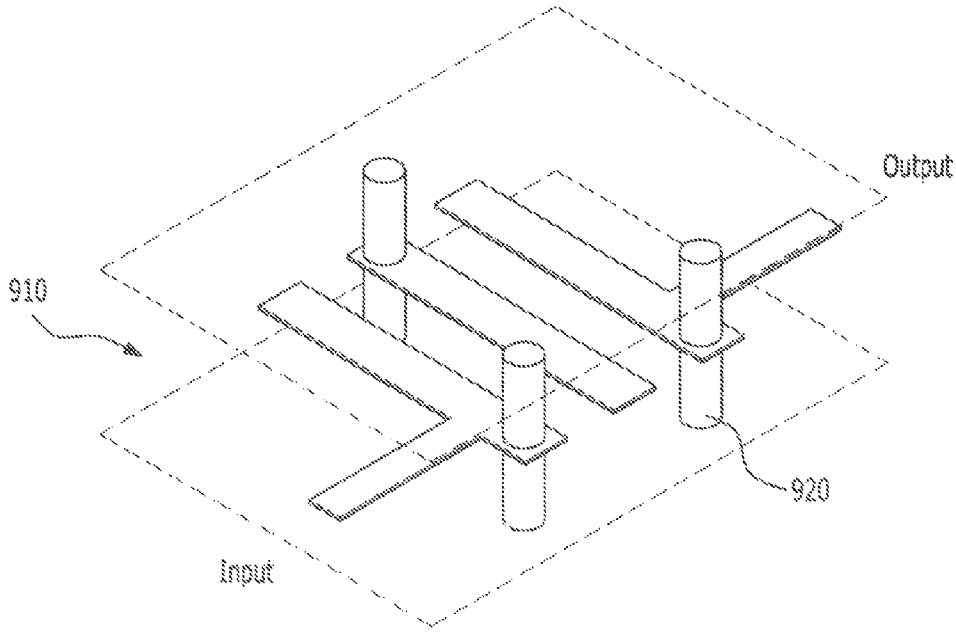
FIG. 9 (PRIOR ART)
FIG. 9 is a perspective view illustrating the typical three-order inter-digital filter of FIG. 1 applied to Low-Temperature Co-fired Ceramic (LTCC) technology.
Figure 10:
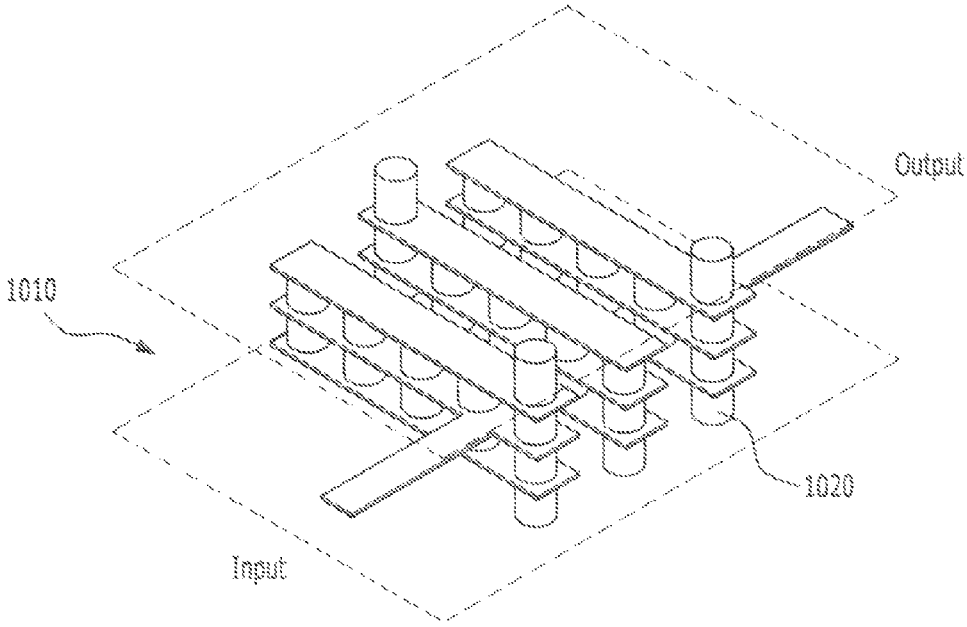
FIG. 10 (PRIOR ART)
FIG. 10 is a perspective view illustrating the typical three-order inter-digital filter of FIG. 1 piled up in three steps.
Figure 11:
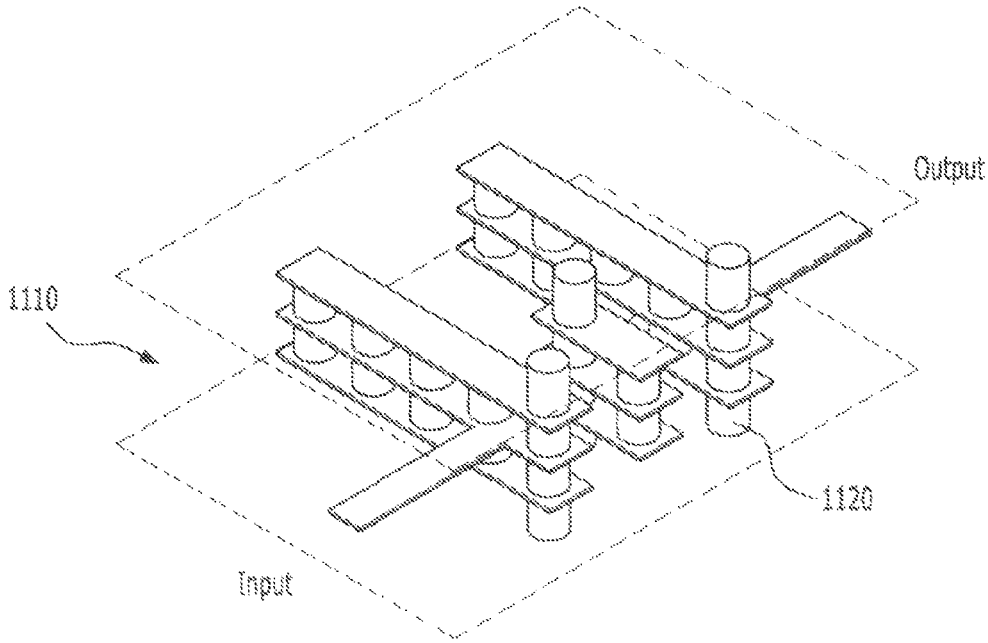
FIG. 11 is a perspective view illustrating the coupled line filter of the second embodiment of the present invention shown in FIG. 3 piled up in three steps by applying the LTCC technology.

FIG. 9 is a perspective view illustrating the typical three-order inter-digital filter of FIG. 1 applied to Low-Temperature Co-fired Ceramic (LTCC) technology. FIG. 10 is a perspective view illustrating the typical three-order inter-digital filter of FIG. 1 piled up in three steps. FIG. 11 is a perspective view illustrating the coupled line filter of the second embodiment of the present invention shown in FIG. 3 piled up in three steps by applying the LTCC technology.

Referring to FIG. 9, an input line, an output line, and a plurality of line resonators constituting a typical three-order inter-digital filter are disposed in an LTCC substrate 910. Here, ground surfaces are provided to the upper and lower surfaces of the LTCC substrate 910. Each of the line resonators in the LTCC substrate 910 has one side connected to the ground substrates through a via 920.

Meanwhile, the actually realized LTCC substrate 910 had a dielectric rate of 5.9 and a loss tangent of 0.002, and the line resonators were formed of transmission lines whose electrical length is 270°.

FIG. 10 shows the typical three-order inter-digital filter of FIG. 1 piled up in three steps. Just as the inter-digital filter shown in FIG. 9, ground surfaces were provided to the upper and lower surfaces of an LTCC substrate 1010, and a plurality of line resonators are connected to the ground surfaces through vias 1020. The line resonators are realized using transmission lines whose electrical length is 270°, just as the line resonators illustrated in FIG. 9.

Referring to FIG. 11, which illustrates the coupled line filter of the second embodiment of the present invention shown in FIG. 3 piled up in three steps and disposed in an LTCC substrate 1110. In this structure, too, the multiple line resonators are connected to ground surfaces through vias 1120. Among the resonators illustrated in FIG. 11, long resonators are formed of transmission lines whose electrical length is 270° at the center frequency, and short resonators are formed of transmission lines whose electrical length is a third as long as the long resonators, i.e., 90°.

The effects of the coupled line filters illustrated in FIGS. 9 to 11 were analyzed using electromagnetic field method, which has high reliability in high frequency circuit analysis. Hereafter, the effects of the filters illustrated in FIGS. 9 to 11 will be described with reference to FIGS. 12 and 13.

Figure 12:
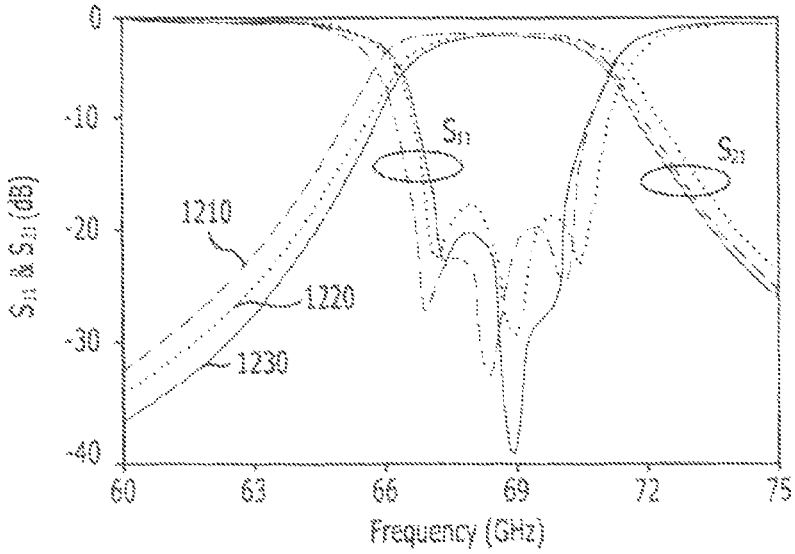
FIG. 12 is a graph comparatively showing reflective coefficients $S_{11}$ and transmission coefficients $S_{21}$ of the coupled line filters of FIGS. 9 to 11.

FIG. 12 is a graph comparatively showing reflective coefficients $S_{11}$ and transmission coefficients $S_{21}$ of the coupled line filters illustrated in FIGS. 9 to 11.

In the graph, reference numeral '1210' is a curve showing reflective coefficient $S_{11}$ and transmission coefficient $S_{21}$ of the coupled line filter illustrated in FIG. 9, and reference numeral '1220' is a curve showing reflective coefficient $S_{11}$ and transmission coefficient $S_{21}$ of the coupled line filter illustrated in FIG. 10. Reference numeral '1230' is a curve showing reflective coefficient $S_{11}$ and transmission coefficient $S_{21}$ of the coupled line filter illustrated in FIG. 11.

It can be seen from the graph of FIG. 12 that the general inter-digital filters shown in FIGS. 9 and 10 have similar reflective coefficients $S_{11}$ and transmission coefficients $S_{21}$. Although not shown in the drawing, the coupled line filter of FIG. 10 still has similar result to the coupled line filter of FIG. 9 when the gap between the line resonators of the coupled line filter of FIG. 10 is widened by more than about 40 μm.

Referring back to FIG. 12, the coupled line filter of the present invention illustrated in FIG. 11 is observed to have similar frequency characteristics to the general inter-digital filters illustrated in FIGS. 9 and 10.

Figure 13:
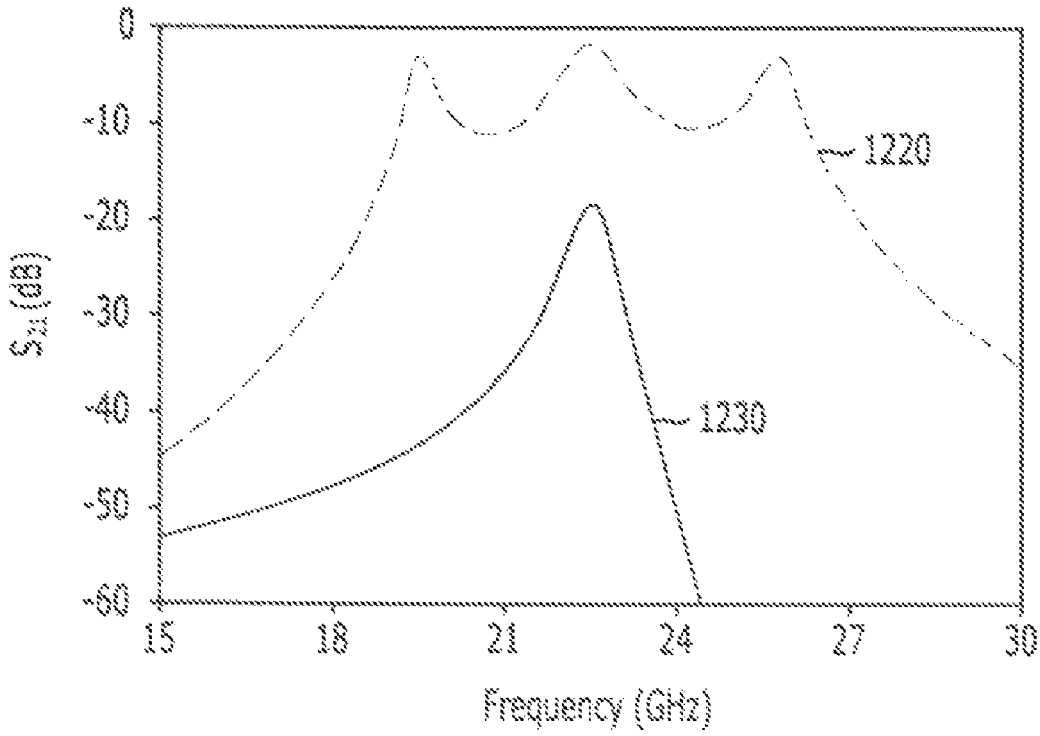
FIG. 13 is a graph comparatively showing the transmission coefficients $S_{21}$ of the coupled line filters of FIGS. 10 and 11.

FIG. 13 is a graph comparatively showing the transmission coefficients $S_{21}$ of the coupled line filters of FIGS. 10 and 11 at low frequency. In the drawing, reference numeral '1220' is a curve showing transmission coefficient $S_{21}$ of the coupled line filter illustrated in FIG. 10, and reference numeral '1230' is a curve showing transmission coefficient $S_{21}$ of the coupled line filter illustrated in FIG. 11.

Referring to FIG. 13, it is observed that the coupled line filter of the present invention illustrated in FIG. 11 has an effect of blocking signals at low frequency band about 20 dB more than the general inter-digital filter shown in FIG. 10. Based on this result, it is expected that the signal block effect will be enhanced at low frequency band when more short line resonators are used in the coupled line filter of the present invention illustrated in FIG. 11.

The present invention provides a coupled line filter having broadband characteristics and low insertion loss.

Also, the present invention provides a coupled line filter that can form a pass band only in a frequency band desired by a user.

In addition, the present invention provides a coupled line filter appropriate for a multi-layer substrate.

While the present invention has been described with respect to the specific embodiments, it will be apparent to those skilled in the art that various changes and modifications may be made without departing from the spirit and scope of the invention as defined in the following claims.

What is claimed is:

1. A coupled line filter, comprising:

a first 270° line resonator having an electrical length of 270° at a predetermined center frequency and coupled to an input port;

a second 270° line resonator coupled to an output port, the first and second 270° line resonators being disposed parallel to each other; and a middle resonator portion disposed between the first 270° line resonator and the second 270° line resonator, the middle resonator portion comprising at least one 90° line resonator having an electrical length of 90° at the predetermined center frequency and a first side aligned with first sides of the first 270° line resonator and the second 270° line resonator, wherein an order of the coupled line filter is determined by summing the number of the line resonators included in the middle resonator portion and the first and second 270° line resonators.

2. The coupled line filter of claim 1, wherein the first sides of the first 270° line resonator and the second 270° line resonator are attached to a ground, and the first side or a second side of each line resonator of the middle resonator portion is attached to the ground.

3. The coupled line filter of claim 1, wherein second sides of the first 270° line resonator and the second 270° line resonator are attached to a ground, and the first side or a second side of each line resonator of the middle resonator portion is attached to the ground.

4. The coupled line filter of claim 1, wherein the middle resonator portion further comprises a plurality of alternating 270° line resonators and 90° line resonators.

5. The coupled line filter of claim 4, wherein the first sides of the first 270° line resonator and the second 270° line resonator are attached to a ground, and within the middle resonator portion, first sides of the 270° line resonators are attached to the ground while first sides or second sides of the 90° line resonators are attached to the ground.

6. The coupled line filter of claim 4, wherein second sides of the first and second 270° line resonators are attached to a ground, and within the middle resonator portion, second sides of the 270° line resonators are attached to the ground while first sides or second sides of the 90° line resonators are attached to the ground.

7. The coupled line filter of claim 4, further comprising: for each 90° line resonator in the middle resonator portion, an opposing 90° line resonator comprising a second side aligned with second sides of each of the plurality of 270° line resonators.

8. The coupled line filter of claim 1, wherein the first 270° line resonator and the second 270° line resonator are formed in a U shape.

9. The coupled line filter of claim 8, wherein the middle resonator portion further comprises a plurality of alternating 270° line resonators and 90° line resonators.

10. The coupled line filter of claim 8, wherein the middle resonator portion further comprises a plurality of 90° line resonators.

11. The coupled line filter of claim 1, wherein the first 270° line resonator, the second 270° line resonator, and the middle line resonator portion are arranged on a first layer, the coupled line filter further comprising a second layer disposed over the first layer, the second layer comprising a plurality of line resonators corresponding to the line resonators of the first layer.

12. The coupled line filter of claim 11, wherein each of the line resonators disposed on the first and second layers is coupled to a ground through a via.

13. A method for forming line resonators in a coupled line filter, comprising:

forming a first 270° line resonator having an electrical length of 270° at a predetermined center frequency and coupled to an input port;

forming a second 270° line resonator coupled to an output port, the first and second 270° line resonators being disposed parallel to each other; and forming a middle resonator portion disposed between the first 270° line resonator and the second 270° line resonator, the middle resonator portion comprising at least one 90° line resonator having an electrical length of 90° at the predetermined center frequency, and a first side aligned with first sides of the first 270° line resonator and the second 270° line resonator.

14. The method of claim 13, further comprising:

connecting the first sides of the first 270° line resonator and the second 270° line resonator to a ground; and connecting the first side or a second side of each line resonator of the middle resonator portion to the ground.

15. The method of claim 13, further comprising:

connecting second sides of the first 270° line resonator and the second 270° line resonator to a ground; and connecting the first side or a second side of each line resonator of the middle resonator portion to the ground.

16. The method of claim 13, further comprising forming a plurality of alternating 270° line resonators and 90° line resonators in the middle resonator portion.

17. The method of claim 16, further comprising:

for each 90° line resonator in the middle resonator portion, forming an opposing 90° line resonator having a second side aligned with second sides of the plurality of 270° line resonators.

18. The method of claim 13, wherein the first 270° line resonator and the second 270° line resonator are formed in a U shape.

19. The method of claim 18, further comprising forming a plurality of alternating 270° line resonators and 90° line resonators in the middle resonator portion.

20. The method of claim 18, further comprising forming a plurality of 90° line resonators in the middle resonator portion.

* * * * *